US006736466B1

(12) United States Patent
Helland et al.

(10) Patent No.: US 6,736,466 B1
(45) Date of Patent: May 18, 2004

(54) PAPER TOWEL DISPENSING APPARATUS

(76) Inventors: Steven R. Helland, 5203 El Cerrito Dr., Riverside, CA (US) 92507; Robert V. Helland, 10305 Ferry Point Pl., Rice, MN (US) 56367

( * ) Notice: Subject to any disclaimer, the term of this patent is extended or adjusted under 35 U.S.C. 154(b) by 45 days.

(21) Appl. No.: 10/228,791

(22) Filed: Aug. 27, 2002

(51) Int. Cl.[7] ..... B65H 61/00
(52) U.S. Cl. ..... 312/34.8; 312/34.9; 312/34.11
(58) Field of Search ..... 312/34.8, 34.9, 312/34.11

(56) References Cited

U.S. PATENT DOCUMENTS

| | | | | | |
|---|---|---|---|---|---|
| 1,976,087 | A | * | 10/1934 | Overholt | 312/34.11 |
| 1,988,266 | A | | 1/1935 | De Bersaques | |
| 2,047,255 | A | | 7/1936 | Colburn | |
| 2,103,403 | A | | 12/1937 | Birr | |
| 2,202,930 | A | * | 6/1940 | Steiner | 312/34.11 |
| 2,255,609 | A | * | 9/1941 | Birr et al. | 312/34.11 |
| 2,289,093 | A | * | 7/1942 | Birr et al. | 312/34.11 |
| 2,425,915 | A | * | 8/1947 | Birr | 312/34.11 |
| 2,470,187 | A | * | 5/1949 | Price | 312/34.11 |
| 2,939,754 | A | * | 6/1960 | Zizzi | 312/34.11 |
| 3,222,112 | A | | 12/1965 | Bahnsen | |
| 3,637,275 | A | | 1/1972 | Bahnsen | |
| 3,858,951 | A | | 1/1975 | Rasmussen | |
| 3,865,323 | A | * | 2/1975 | Stronge et al. | 242/588.6 |
| 4,170,390 | A | | 10/1979 | McCabe | |
| 4,243,278 | A | | 1/1981 | Gray | |
| 4,270,818 | A | | 6/1981 | McCabe | |
| 4,408,811 | A | | 10/1983 | Richardson et al. | |
| 4,448,462 | A | | 5/1984 | Smith | |
| 4,573,750 | A | | 3/1986 | Golby | |
| 4,579,398 | A | | 4/1986 | Golby | |
| 4,676,559 | A | | 6/1987 | Hood et al. | |
| 4,746,907 | A | | 5/1988 | Zehnder, Jr. | |
| 4,818,042 | A | | 4/1989 | Arabian et al. | |
| 4,828,343 | A | * | 5/1989 | Murano | 312/34.11 |
| 4,848,854 | A | | 7/1989 | Kennedy | |
| 4,997,239 | A | | 3/1991 | Crisp et al. | |
| 4,999,611 | A | | 3/1991 | Zehnder, Jr. | |
| 5,061,232 | A | * | 10/1991 | Bloch et al. | 493/395 |
| 5,865,395 | A | | 2/1999 | Wei | |
| 6,053,355 | A | | 4/2000 | Rupp et al. | |

* cited by examiner

*Primary Examiner*—Janet M. Wilkens
(74) *Attorney, Agent, or Firm*—Holland & Knight LLP

(57) ABSTRACT

A paper towel dispensing apparatus and an assembly for converting a cloth towel dispensing apparatus into a paper towel dispensing apparatus wherein the assembly is of the type employing a wall-mounted cabinet, a roll of toweling carried in a towel bin from which the toweling is withdrawn and directed upwardly between a first drive roller and a pinch roller, about the pinch roller and downwardly, forming a depending loop from which the toweling is directed upwardly between a second drive roller and a take-up roller and is rolled about the take-up roller. As the user dries his hands on the loop of toweling and pulls downwardly on the toweling, a limited amount of clean paper toweling is pulled from the roll and an equal amount is wrapped about the take-up roller. To provide the proper handling of the paper toweling, the take-up roller is constructed of solid steel, the drive rollers are provided with flexible rubber coverings and the towel bin is sized to precisely maintain the proper alignment of the towel roll therein.

15 Claims, 3 Drawing Sheets

22
24
12
29
28
30
70
10
82
80
18
32
20
16
84
34'
34
32'
16'
3
3
26
16
14
10
12
22
20
29
58
26
16
62
60
14
16'
42
50
44
44
50
48
46
40
48

PAPER TOWEL DISPENSING APPARATUS

BACKGROUND OF THE INVENTION

The present invention relates to towel dispensers of the type commonly used in public restrooms that employ a roll of toweling in which the toweling is withdrawn from a supply roll in a cabinet and forms a dependent loop accessible to the user drying his or her hands. The toweling is dispensed from the cabinet in successive portions in response to a pulling action by the user and the toweling is likewise continually taken up into the cabinet. The use of such dispensers in public restrooms is quite common and efforts to improve the working mechanisms employed therein are ongoing. Examples of such mechanisms are found in U.S. Pat. Nos. 4,579,398 and 4,999,611. In these devices as in most other hand drying devices in which a towel is dispensed from a roll, the toweling is formed of cloth. As a result, the cloth roll is sufficiently expensive that it is not generally economically feasible to simply discard the soiled roll. As a result, when the entire length of the roll has been used, it must be collected from the apparatus, cleaned and re-rolled and a new, fresh roll of cloth installed in the dispensing apparatus. The cost of maintaining such towel dispensing devices could be significantly reduced if disposable paper rolls could be employed in lieu of the cloth rolls. Efforts to substitute paper rolls for cloth rolls, however, have heretofore proved unsuccessful due to the inability of the cloth take-up mechanisms employed in such dispensing devices to properly handle rolls of paper. It has been found that far better control of a paper roll is required in such a dispensing mechanism than is required with conventional cloth rolls. While some twisting and lateral movement of the roll of toweling can be accommodated with such mechanisms when the toweling is formed of cloth, such movement cannot be accommodated using paper rolls. The device will jam. Also, if the mechanism employed to more precisely handle a paper roll is appreciably more expensive than those employed with cloth roll dispensers, the economic advantages of using a paper roll are lost. It would be highly desirable to provide a towel roll dispenser which can accommodate disposable paper towel rolls in which the handling mechanism is not appreciably more costly than that employed with paper rolls. It would also be highly desirable if existing cloth roll dispensers could be easily and economically modified so as to be able to handle disposable rolls of paper as opposed to cloth. The present invention achieves both these results.

It is therefore the principal object of the present invention to provide a towel dispenser of the type employing a roll of toweling in which the toweling is withdrawn from a supply roll in a cabinet and forms a dependent loop accessible to the user drying his or her hands wherein the toweling is formed of paper.

It is another object of the present invention to provide such a towel dispenser that is of simple construction and economical to manufacture.

It is a further object of the present invention to provide a mechanism for converting a towel dispenser of the type employing a roll of cloth toweling in which the toweling is withdrawn from a supply roll in a cabinet and forms a dependent loop accessible to the user to dry his or her hands into a dispensing apparatus capable of handling a roll of paper toweling.

It is yet another object of the present invention to provide such a mechanism that is of simple construction and economical to manufacture and install.

These and other objects and advantages of the present invention will become readily apparent from the following detailed description taken in conjunction with the accompanying drawings.

IN THE DRAWINGS

DETAILED DESCRIPTION OF THE PREFERRED EMBODIMENTS

Figures 1, 2, 3:
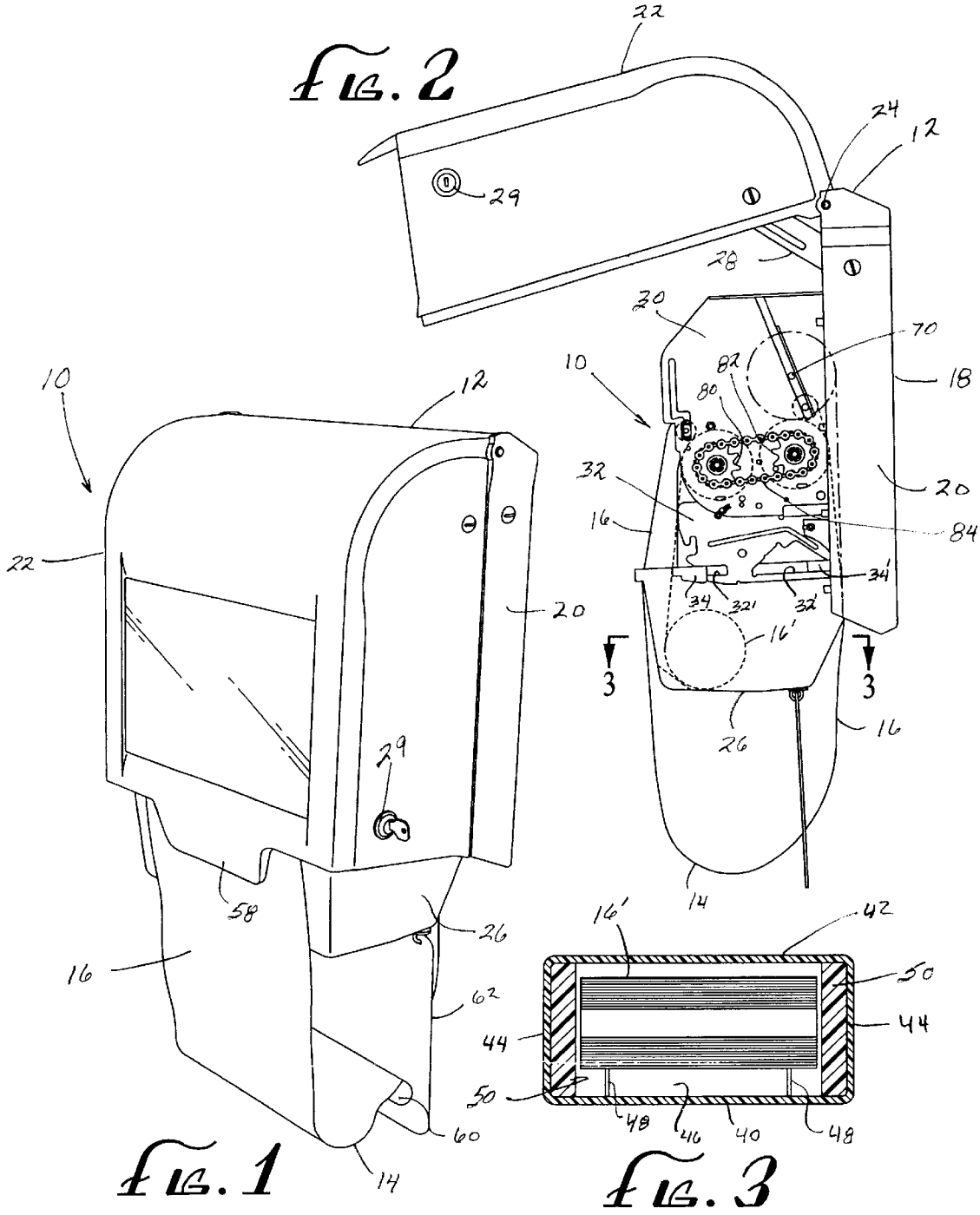
FIG. 1 is a perspective view of a towel dispensing apparatus of the present invention.
FIG. 2 is a side view of the towel dispensing apparatus of the present invention with the front cover shown in the elevated position.
FIG. 3 is a side view taken along the line 3—3 of FIG. 2.

Referring now in detail to the drawings, the overall configuration and operation of towel dispenser 10 is very similar to those disclosed and described in U.S. Pat. Nos. 4,579,398 and 4,999,611, both of which are hereby incorporated by reference as though fully set forth herein. The dispenser 10 of the present invention comprises a cabinet 12 adapted to be secured to a washroom wall at a suitable elevation to provide convenient access to the loop 14 defined by toweling 16. The cabinet includes a backing 18 adapted to be fixed to the washroom wall, opposed side walls 20 integrally formed with backing 18, a front cover 22 pivotally secured to side walls 20 by pivot mounts 24 and a lower towel bin 26 adapted to house a roll 16' of clean toweling 16. A suitable latching mechanism 28 is operatively connected between one of side walls 20 and cover 22 to selectively secure the front cover 22 in the elevated open position to provide access to the towel bin 26 as well as the interior of cabinet 12. A suitable locking mechanism 29 is also provided to secure the cover 22 in the closed position.

Secured within cabinet 12 are a pair of opposed upper side plates 30 for supporting the various towel handling components and a pair of lower side plates 32 carried by plates 30 for supporting the towel bin 26 by means of integrally formed spaced tabs 34 which project laterally from the sides of bin 26 and ride on support surfaces 32' defined by the lower side plates 32. Note that from the perspective of FIG. 4, only the supporting tabs 34 and support surfaces 32' on the right side of the towel bin 26 are visible. It is to be understood that the opposed sides of the bin and lower side plates are of identical configuration. Through this configuration, the towel bin 26 can be tilted forwardly to receive a fresh new roll 16' of toweling as illustrated in FIG.

6 and can be readily removed and replaced as needed. Other means of securing the towel bin in place could also be employed.

In a paper towel dispensing apparatus, it is critical that the roll 16' of clean paper toweling 16 be maintained in a "square" disposition in the towel bin and that it neither twists nor translates from side to side. While such movement can be tolerated in cloth towel dispensers, with paper toweling, such movement will result in the jamming of the dispenser. Accordingly, the towel bin used in a standard cloth towel dispensing apparatus requires modification before it can be employed in a paper towel dispenser. A standard towel bin, like bin 26 in the present invention, typically defines inclined front and rear walls 40 and 42, side walls 44, a bottom wall 46 and a pair of laterally spaced inclined stops 48 extending between a forward portion of the bottom wall 46 and adjacent lower portions of the front wall 40 so as to provide an inclined surface adjacent the roll of toweling so as to maintain the roll in a slightly rearward inclination within the bin 26. To provide and maintain the desired square alignment of towel roll 16 within the bin, it is important that side walls of the bin are parallel and spaced apart not more than about 8–10 mm more than the width of the toweling. As this is not the case with typical towel bins such as bin 26, shown in the drawings, a pair of blocks 50, which can be formed of a foam or other suitable lightweight and inexpensive material, are positioned adjacent the front, rear and side walls 40–44 of the bin. Blocks 50 are configured and sized so as to fit snugly against the walls of the towel bin and define a spacing between each of the blocks 50 and the ends 16" of the towel roll 16 of no more than 5 mm. Accordingly, as the toweling 16 moves from roll 16' through the dispenser 10, the roll 16' is continuously maintained in a true horizontal axis within the towel bin 26.

As is discussed later herein, the towel bin could and will be designed to maintain the desired alignment of the toweling roll without the need of spacing members and as blocks 50. However, a significant feature of the present invention is the ease with which existing cloth continuous loop type dispensers can be converted to a disposable paper roll dispenser.

Figure 5:
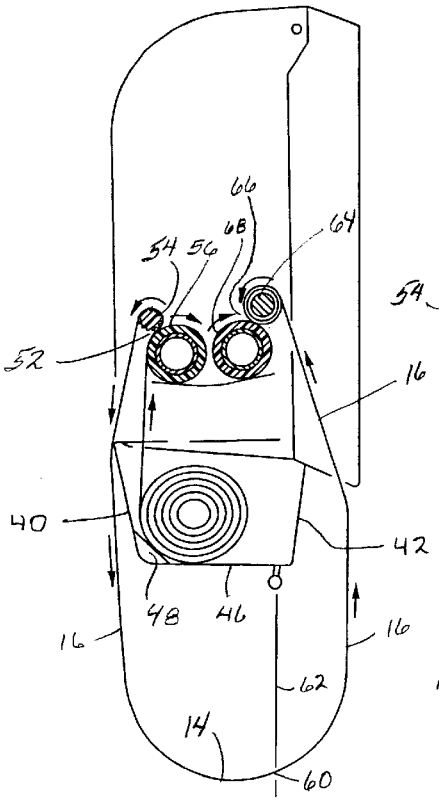
FIG. 5 is a schematic side view of the towel dispensing apparatus of the present invention illustrating the path of the toweling therethrough.
Figure 4:
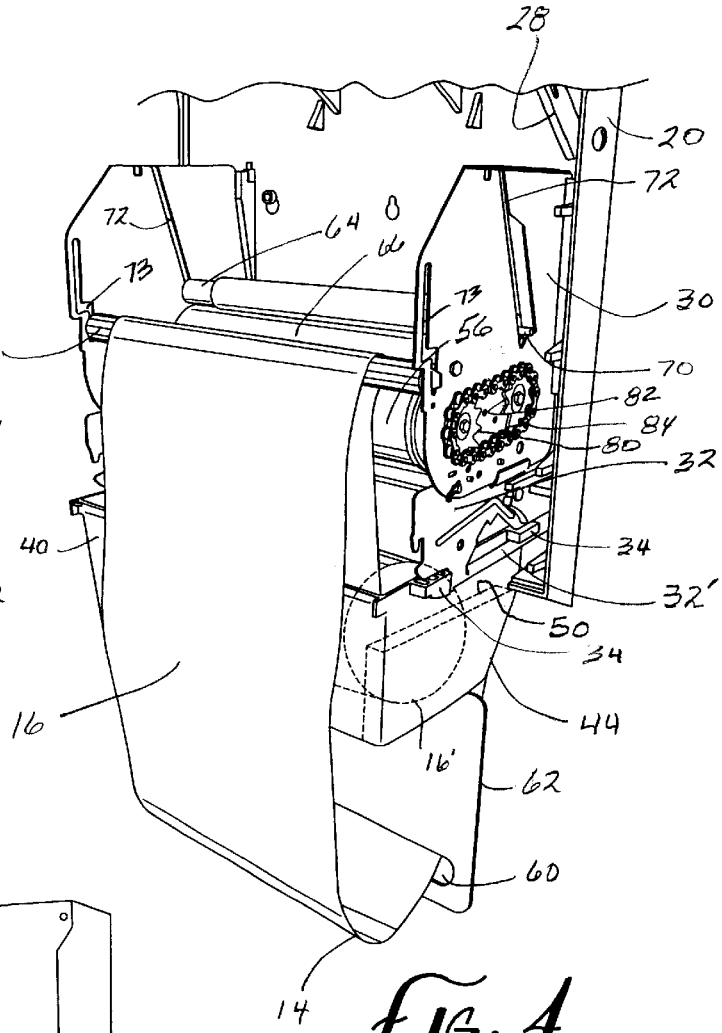
FIG. 4 is a perspective view of a portion of the towel dispensing apparatus of the present invention with the cover removed so as to illustrate the mechanisms employed therein.
Figure 6:
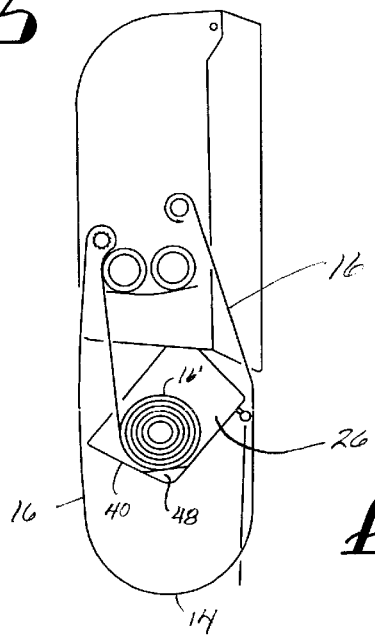
FIG. 6 is a schematic side view of the towel dispensing apparatus of the present invention illustrating the towel bin in a lowered tilted position.

As seen in FIGS. 4 and 5, the roll 16' of clean toweling 16 is contained in the bottom of towel bin 26 adjacent stops 48 and the toweling 16 extends upwardly from roll 16' and into the nip 52 between a first floating cylindrical pinch roller 54 and a first cylindrical drive roller 56. The toweling then passes counterclockwise about floating roller 54 and downwardly, exiting cabinet 12 between the depending tongue 58 on the bottom of cabinet cover 22 and the front wall 40 of towel bin 26. The toweling 16 then passes rearwardly through a slot 60 in a pivotally mounted protective plastic flap 62 depending from the underside of towel bin 26 and forming towel loop 14 where a user dries his or her hands on the towel (see arrows in FIG. 5). From slot 60, the toweling passes upwardly about the back side of the towel bin 26 and back into the cabinet. It then passes in a counterclockwise direction around a second floating cylindrical roller 64 and into the nip 66 between roller 64 and a second cylindrical drive roller 68. The toweling is wrapped about roller 64 so as to wind up thereon during use as illustrated in phantom lines in FIG. 2. Eventually the entire length of toweling 16 is wound onto roller 64. The direction of rotation of the rollers is shown by arrows in FIG. 5. Thus, roller 64 defines a take-up roller. To enable roller 64 to accommodate the entire length of toweling thereon, the roller is provided with axial projections 70 that extend from the opposed ends thereof and are slidably disposed within slots 72 inside plates 30. Thus, as the take-up roller accumulates more toweling thereon, the roller can slide upwardly along slots 72. The first floating roller 54 similarly moves within guide slots 73.

In a conventional towel dispenser using cloth toweling, the floating take-up roller is formed of a lightweight material such as wood or plastic. However, in dispenser 10, the take-up roller 64 is formed of steel, is about 0.75 in diameter and weighs approximately 2.2 lbs. so as to press more heavily against the second drive roller 68 and thereby maintain the proper alignment and tension in the paper toweling as it wraps about the take-up roller 64. Without the added weight of the steel in roller 64, paper toweling will not feed properly through the dispenser 10. In addition to take-up roller 64, the first and second drive rollers 56 and 68 are provided with a neoprene rubber surface as opposed to a sandpaper or other rigid rough roller surfaces used to grip cloth toweling. It has been found that the surfaces of the conventional drive rollers do not adequately engage the paper toweling which causes slippage. By providing the drive rollers with a somewhat flexible outer gripping surface having a relatively high coefficient or friction, the contact with the paper toweling is significantly enhanced so as to precisely move the toweling through the dispensing device. The rubber surface can be provided on the main drive rollers in several ways, e.g., a rubber sock which can be heat-shrunk and glued in place on the surface of the cylindrical rollers. While materials other than rubber may prove viable on the drive roller surfaces, a somewhat flexible surface having a sufficiently high coefficient of friction so as to be somewhat tacky to the touch as opposed to or somewhat slick or slippery surface or a rigid surface such as sandpaper has proved highly successful in the operation of dispenser 10.

Conventional end sprockets 80 and 82 are provided at the ends of the drive rollers 56 and 68, respectively. The sprockets are connected by means of a chain 84 whereby a downward pull on the loop 14 formed by the toweling 16 causes the first floating roller 54 to press against the first drive roller 56 so that the toweling is firmly gripped between rollers 54 and 56 and drive is transmitted to roller 56 and thence via chain 84 to the second drive roller 68. The drive towel roller frictionally engages the take-up roller 64 causing the take-up roller to rotate and wrap the used toweling about its surface at the same rate that it is dispensed from roll 16', whereby the loop 14 of toweling remains at a constant length throughout the period of use. A limiting mechanism (not shown) is provided to limit the length of towel which can be obtained by a user at a single pull on the towel loop portion 14. Any conventional limiting mechanism can be employed and a variety of such mechanisms are in common use on conventional cloth roll towel dispensers. An example of such a mechanism is described in U.S. Pat. No. 4,579,398.

With the exception of the toweling 16, the remainder of the dispenser, including the limiting mechanism, is identical to that found in a cloth towel roll dispenser. The roll of paper toweling preferably employed with the present invention is comprised of 125 feet of 6×2 scrim, a minimum of about 150 denier, 4-ply white embossed paper (although 2 and 3 ply paper could be employed), preferably about 9.75 inches wide, has a core of about 1.5 inches and an outer diameter of about 4.3–4.5 inches. Thus, the toweling roll 16 is somewhat more loose and wider than conventional paper rolls. While narrower rolls could be employed, the wider rolls is more conventional for the user. Suitable paper for dispenser 10 can be obtained from SRH, Inc. of Clearwater, Minn. under the name of Nature's Linen.

Thus, by replacing the lightweight take-up roller found in a conventional cloth roll dispenser with the heavier steel take-up roller 64 of the present invention, eliminating the rough surfaces on the drive rollers 56 and 60 and substituting therefor rollers with softer rubber surfaces, and providing the spacing blocks 50 in the towel bin 26 as described above to provide the desired minimal clearance between the ends of the roll of toweling and side walls of the towel bin, the resulting dispenser 10 will dispense and handle paper toweling in the same manner as conventional dispensers provide a continuous loop of cloth toweling for the drying of one's hands. The resulting economic savings is substantial.

Figure 7:
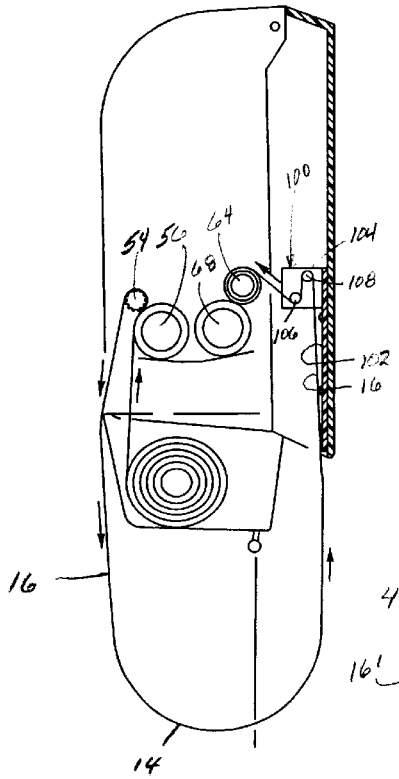
FIG. 7 is a schematic side view of the towel dispensing apparatus of the present invention illustrating the path of the toweling therethrough wherein the dispensing apparatus is provided with a guide and tensioning assembly for handling longer paper rolls for improved guidance and friction.
Figure 8:
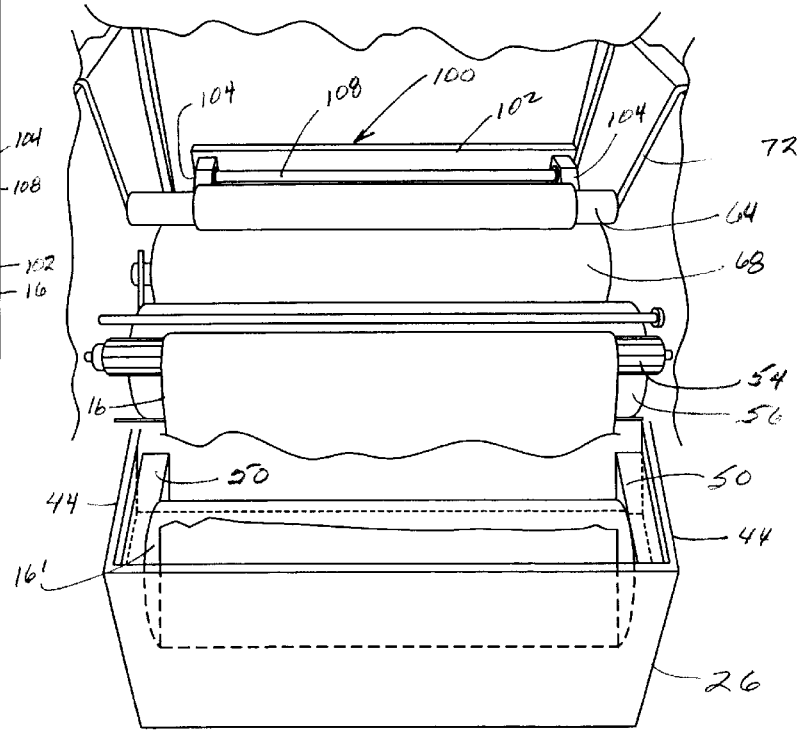
FIG. 8 is a partial perspective view showing the interior of the dispensing apparatus provided with the guide and tensioning-assembly for handling longer paper rolls.

In the embodiment of the present invention described above and illustrated in FIGS. 1–6, the length of the roll of paper toweling is preferably about 125 feet. To accommodate longer rolls in the nature of 200 feet, additional tensioning must be provided to enhance further the guidance of the roll through the dispenser and to provide additional friction for the roll as it moves through the dispenser. The additional guidance and friction is provided by the roller insert assembly 100 seen in the embodiment of the dispenser illustrated in FIGS. 7 and 8. As seen therein, the insert is secured to the backing 18 of the cabinet and comprises a mounting plate 102, side walls 104, a lower forward cylindrical steel roller 106 and a rear cylindrical steel roller 108. Roller 106 and 108 are about 0.025 inches in diameter and define a spacing of about ⅞ inches therebetween. As the toweling moves upwardly within the rear portion of the cabinet, the toweling passes counterclockwise about the rear upper roller 108 of the assembly, downwardly about forward lower roller 106 and about the steel take-up roller 64. Other mounting assemblies could, of course, be utilized to secure rollers 106 and 108 in place. The remainder of the path of travel of the toweling is identical to that described in the prior embodiment. Through the addition of guidance and friction device, the longer rolls of paper toweling can be accommodated.

While the above description of the present invention was directed to modifying an existing cloth towel dispenser to accommodate paper rolls, it is to be understood that the above components could be provided in a dispenser designed and built to handle paper toweling. In such a design, the towel bin would be configured so as to be more of a "V"-shaped configuration having side walls spaced apart 8 to 10 millimeters more than the width of the toweling which presently is 9.75 inches wide. Such a configuration would maintain the roll in the desired true longitudinal disposition.

Various changes and modifications can be made in carrying out the present invention without departing from the spirit and scope thereof. Insofar as these changes and modifications are within the purview of the appended claims, they are to be considered as part of the present invention.

We claim:

1. A towel dispensing apparatus adapted for use with a roll of disposable paper toweling of a predetermined width, said apparatus comprising:

a cabinet;

a first drive roller rotatably mounted at a fixed position within said cabinet;

a pinch roller rotatably mounted within said cabinet upwardly adjacent said first drive roller;

a second drive roller rotatably mounted at a fixed position within said cabinet rearwardly of said first drive roller;

a take-up roller rotatably mounted within said cabinet upwardly adjacent said second drive roller and being freely movable in a horizontal disposition along an upwardly inclined path, said take-up roller having a weight in excess of about two pounds;

a towel bin carried by said cabinet below said rollers, said bin defining a transverse dimension of not more than about 8–10 millimeters greater than the width of the roll of paper toweling; and a chain drive mechanism operatively connected between said first and second drive rollers for synchronously rotating said first and second drive rollers upon one pulling downwardly on the paper toweling below said cabinet.

2. The dispensing apparatus of claim 1 wherein said first and second drive rollers each define an outer cylindrical surface having a rubber covering thereon.

3. The towel dispensing apparatus of claim 1 wherein said take-up roller is constructed of metal.

4. The towel dispensing apparatus of claim 1 including a guidance and friction assembly for allowing the dispensing apparatus to be used with longer rolls of disposable paper toweling, said guidance and friction assembly comprising a pair of horizontally disposed cylindrical rollers spaced apart in a fixed disposition with said cabinet rearwardly of said take-up roller such that one of the guidance and friction rollers is spaced below and closer to said take-up roller than the other of said guidance and friction rollers whereby the toweling passing to said take-up roller first passes about said guidance and friction rollers.

5. A towel dispensing apparatus adapted for use with a roll of disposable paper toweling of a predetermined width, said apparatus comprising:

a cabinet;

a first drive roller rotatably mounted at a fixed position within said cabinet;

a pinch roller rotatably mounted within said cabinet upwardly adjacent said first drive roller;

a second drive roller rotatably mounted at a fixed position within said cabinet rearwardly of said first drive roller;

a take-up roller rotatably mounted within said cabinet upwardly adjacent said second drive roller and being freely movable in a horizontal disposition along an upwardly inclined path, said take-up roller having a weight in excess of about two pounds;

a towel bin carried by said cabinet below said rollers, said bin defining opposed lateral sides;

a pair of spacing members disposed in said towel bin, one of said members being adjacent each of said sides of said bin, said spacing members being spaced apart a transverse dimension of not more than about 8–10 mm greater than the width of the roll of paper toweling; and a chain drive mechanism operatively connected between said first and second drive rollers for synchronously rotating said first and second drive rollers upon one pulling downwardly on the paper toweling below said cabinet.

6. The towel dispensing apparatus of claim 5 wherein said first and second drive rollers each define an outer cylindrical surface having a rubber covering thereon.

7. The towel dispensing apparatus of claim 5 wherein said take-up roller is constructed of metal.

8. The towel dispensing apparatus of claim 5 including a guidance and friction assembly for allowing the dispensing apparatus to be used with longer rolls of disposable paper toweling, said guidance and friction assembly comprising a pair of horizontally disposed cylindrical rollers spaced apart in a fixed disposition with said cabinet rearwardly of said take-up roller such that one of the guidance and friction rollers is spaced below and closer to said take-up roller than the other of said guidance and friction rollers whereby the toweling passing to said take-up roller first passes about said guidance and friction rollers.

9. A paper towel dispensing apparatus comprising:

a cabinet;

a first drive roller rotatably mounted at a fixed position within said cabinet;

a pinch roller rotatably mounted within said cabinet upwardly adjacent said first drive roller;

a second drive roller rotatably mounted at a fixed position within said cabinet rearwardly of said first drive roller;

a take-up roller rotatably mounted within said cabinet upwardly adjacent said second drive roller and being freely movable in a horizontal disposition along an upwardly inclined path, said take-up roller being constructed having a weight in excess of about two pounds;

a towel bin defining opposed parallel side walls, said bin being carried by said cabinet below said rollers;

a roll of paper toweling disposed within said towel bin, the toweling extending from said roll upwardly between said first drive roller and said pinch roller, about said pinch roller and downwardly from said cabinet, forming a loop below said cabinet and extending from said loop upwardly into said cabinet about said take-up roller and between said take-up roller and said second drive roller and wrapping about said take-up roller, said roll defining extended ends and being disposed in said towel bin in a horizontal disposition and wherein each of the ends thereof are each spaced from the sides of said towel bin a distance not greater than about 5 mm; and a chain drive mechanism operatively connected between said first and second drive rollers for synchronously rotating said first and second drive rollers upon one pulling downwardly on said loop defined by said roll of paper toweling.

10. The dispensing apparatus of claim 9 wherein said first and second drive rollers each define an outer cylindrical surface having a rubber covering thereon.

11. The towel dispensing apparatus of claim 9 wherein said take-up roller is constructed of metal.

12. The towel dispensing apparatus of claim 9 including a guidance and friction assembly for allowing the dispensing apparatus to be used with longer rolls of disposable paper toweling, said guidance and friction assembly comprising a pair of horizontally disposed cylindrical rollers spaced apart in a fixed disposition with said cabinet rearwardly of said take-up roller such that one of the guidance and friction rollers is spaced below and closer to said take-up roller than the other of said guidance and friction rollers whereby the toweling passing from said loop to said take-up roller first passes about said guidance and friction rollers.

13. An assembly for converting a cloth towel dispensing apparatus into a paper towel dispensing apparatus wherein the apparatus is of the type employing a wall-mounted cabinet, a roll of toweling disposed in a towel bin within the cabinet from which the toweling is withdrawn and directed upwardly between a first drive roller and a pinch roller, about the pinch roller and downwardly, forming a dependent loop below the cabinet from which the toweling is directed upwardly between a second drive roller and a take-up roller adjacent said second drive roller and is rolled about the take-up roller, the second drive roller being operatively connected to the first drive roller such that pulling on the loop in the drying of one's hands causes a limited amount of toweling to be pulled from the roll and an equal amount wrapped about the take-up roller, said conversion assembly comprising:

a cylindrical take-up roller having a weight of at least about two pounds;

a pair of replacement drive rollers, each of said drive rollers having a rubber outer cylindrical surface;

a roll of paper toweling of a predetermined width; and a pair of spacing members adapted to be disposed in said towel bin adjacent opposite sides thereof, said spacing members being sized such that upon being disposed in the bin adjacent the sides thereof, said members are spaced apart a transverse dimension of not more than about 8–10 mm greater than the width of the roll of paper toweling.

14. The towel dispensing apparatus of claim 13 wherein said take-up roller is constructed of metal.

15. The towel dispensing apparatus of claim 13 including a guidance and friction assembly for allowing the dispensing apparatus to be used with longer rolls of disposable paper toweling, said guidance and friction assembly comprising a pair of horizontally disposed cylindrical rollers spaced apart in a fixed disposition with said cabinet rearwardly of said take-up roller such that one of the guidance and friction rollers is spaced below and closer to said take-up roller than the other of said guidance and friction rollers whereby the toweling passing from said loop to said take-up roller first passes about said guidance and friction rollers.

* * * * *